US006257095B1

(12) United States Patent
Yukness

(10) Patent No.: US 6,257,095 B1
(45) Date of Patent: Jul. 10, 2001

(54) LIGHT BULB INSTALLATION AND REMOVAL TOOL

(76) Inventor: William R. Yukness, 1400 S. Highland Ave., Lombard, IL (US)

( * ) Notice: Subject to any disclaimer, the term of this patent is extended or adjusted under 35 U.S.C. 154(b) by 0 days.

(21) Appl. No.: 09/602,139

(22) Filed: Jun. 23, 2000

(51) Int. Cl.[7] ..... H01K 3/32
(52) U.S. Cl. ..... 81/53.11; 294/19.1
(58) Field of Search ..... 81/53.1, 53.11; 294/19.1

(56) References Cited

U.S. PATENT DOCUMENTS 1,764,278 * 6/1930 Olby ..... 81/53.11
2,357,104 * 8/1944 Grinnell ..... 81/53.11
2,766,060 * 10/1956 Fuller ..... 81/53.11
4,663,996 * 5/1987 Grudgfield et al. ..... 81/53.1
5,730,033 * 3/1998 Mitrowski ..... 81/53.11
5,809,850 * 9/1998 Tickner ..... 81/53.11
5,829,324 * 11/1998 Secor ..... 81/53.11

* cited by examiner

*Primary Examiner*—Eileen P. Morgan
*Assistant Examiner*—Joni B. Danganan
(74) *Attorney, Agent, or Firm*—Wood, Phillips, VanSanten, Clark & Mortimer

(57) ABSTRACT

A tool is provided to install and remove light bulbs, the tool including a base and at least one shaft-like finger fixedly attached to the base. The finger has a tip with a resilient gripping surface to transmit rotational movement of the finger to a base of a light bulb, preferably a spiral light bulb, with the surface abutting the base of the light bulb.

4 Claims, 3 Drawing Sheets

LIGHT BULB INSTALLATION AND REMOVAL TOOL

FIELD OF THE INVENTION

The invention is directed to a tool for installing and removing light bulbs, and in particular, to a tool for installing and removing non-globe type light bulbs.

BACKGROUND OF THE INVENTION

While light bulbs have varying life expectancies, eventually all light bulbs need to be replaced. The difficulty arises in that light fixtures are always not easily accessible. For example, a light fixture used in a large auditorium, or even in an office with a high ceiling, may be at least ten feet above the floor.

In order to install or remove a light bulb from a remotely disposed light fixture, it is typically necessary to use a ladder to reach the light bulb. Alternatively, it is known to use a tool having a large pole with a recovery device on the end, the recovery device having a structure to grasp the globe-like outside of the light bulb. For example, the structure may include one or more arms which elastically deform around the globe of the light bulb to securely grasp the globe and transmit a rotational movement of the pole into a rotational movement of the bulb.

In the recent past, advances in light bulb technology have brought about new shapes for light bulbs. Gone are the days when all light bulbs had a globe-like appearance. The newer, longer-life light bulbs (e.g., BIAX and SPIRALUX-type bulbs) have, for example, a pair of bi-axial tubes or a spiral tube which is connected to a cylindrical base which is screwed into a socket. If one were to use a recovery device such as described above, with the elastically deformable arms, to attempt to install or remove one of the newer spiral light bulbs, one may find that the arms can cause breakage of the tube before installation is even attempted. Once the base of the bulb is in place and is attempted to be rotated within the socket to snugly fit the base in the socket, breakage can also occur.

Consequently, the newer spiral-type light bulbs are usually installed by hand using a ladder.

SUMMARY OF THE INVENTION

According to an aspect of the invention, a tool is provided to install and remove light bulbs, the tool including a base and at least one shaft-like finger fixedly attached to the base. The finger has a tip with a resilient gripping surface to transmit rotational movement of the finger to a base of a light bulb with the surface abutting the base of the light bulb.

According to another aspect of the invention, the tool includes a substantially cylindrical base having a circular first end and a second end. The base has a wall at the second end defining a threaded receptacle attachable to a threaded end of a pole. The tool also includes at least two substantially straight, shaft-like fingers fixedly attached to the first end of the base and spaced along a diameter of the circular first end. Each finger has a beveled tip with a resilient gripping surface to transmit rotational movement of the finger to a base of a non-globe light bulb with the surface abutting the base of the non-type light bulb. The tool may also include a pole having a threaded end disposable in the threaded receptacle to secure the pole to the base.

According to a further aspect of the invention, the tool includes a base having a first end and a second end. The tool also includes a first shaft-like finger fixedly attached to the base having a tip with a resilient gripping surface to transmit rotational movement of the finger to a base of a light bulb with the surface abutting the base of the light bulb, and a second shaft-like finger selectively securable to the base and having a tip with a resilient gripping surface to transmit rotational movement of the finger to a base of a light bulb with the surface abutting the base of the light bulb. The tool also includes a securing mechanism to secure the second shaftlike finger to the base with the first and second shaft-like fingers spaced apart.

DETAILED DESCRIPTION OF THE EMBODIMENTS

Figure 1:
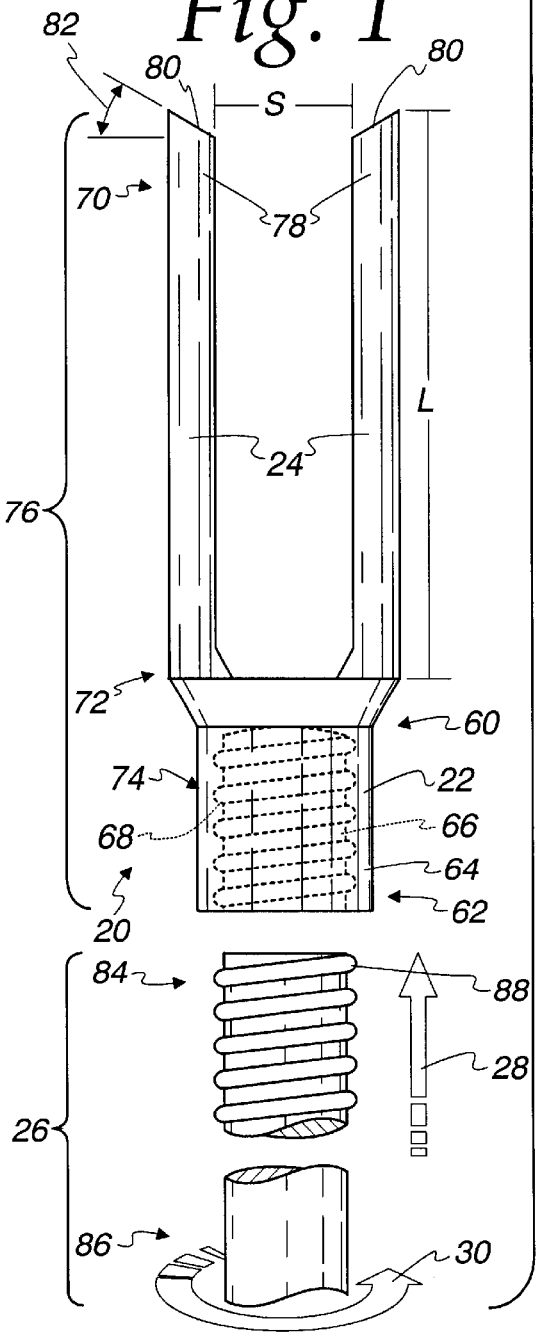
FIG. 1 is an exploded, side view of an embodiment of a tool for installing and removing non-globe type light bulbs according to the invention.
Figure 2:
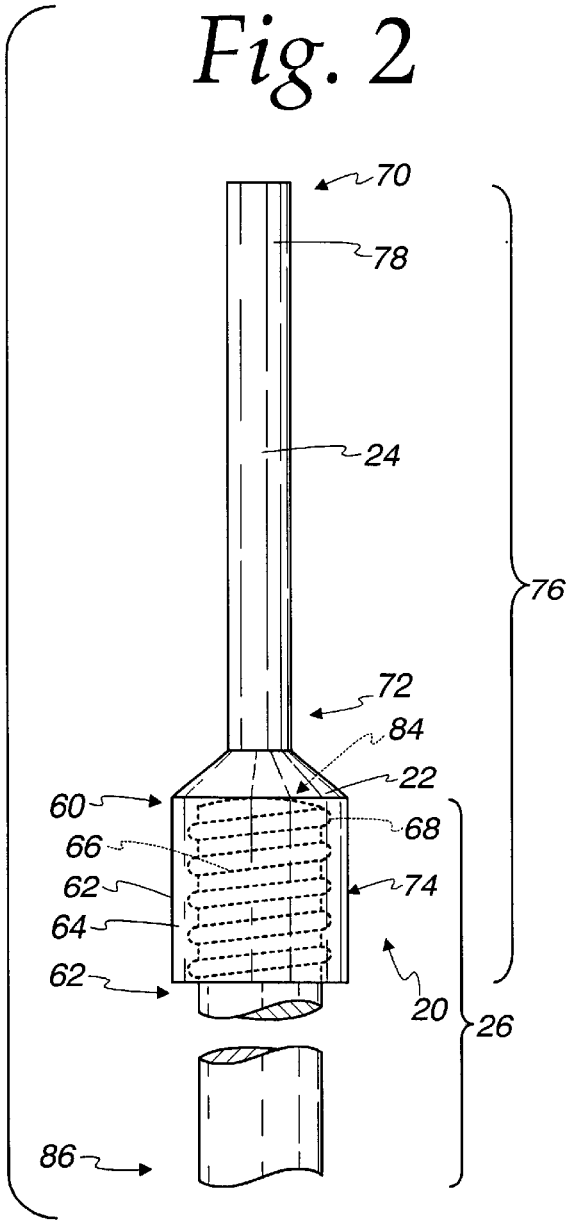
FIG. 2 is a side view of the assembled tool of FIG. 1.
Figure 3:
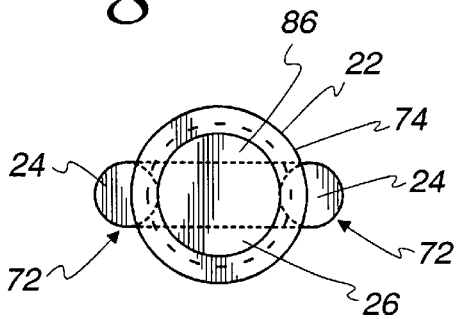
FIG. 3 is a bottom view of the assembled tool of FIG. 1.

FIGS. 1–3 show a tool 20 according to an embodiment of the invention. The tool 20 according to the embodiment shown includes a base 22, at least one, preferably two, shaft-like fingers 24, and a pole 26. The fingers 24 are fixedly attached to the base 22. The base 22 is attached via a threading engagement to the pole 26.

Specifically, the pole 26 is attached to the base 22 by moving the pole 26 in the direction of the arrow 28 shown in FIG. 1 until the threaded portions of the base 22 and pole 26 abut. The pole 26 is then moved in a rotational direction relative to the base 22, as shown by arrow 30 in FIG. 1. With the threaded portion of the pole 26 fully advanced into the threaded portion of the base 22, the tool 20 is ready for use, as shown in FIG. 2.

Figure 4:
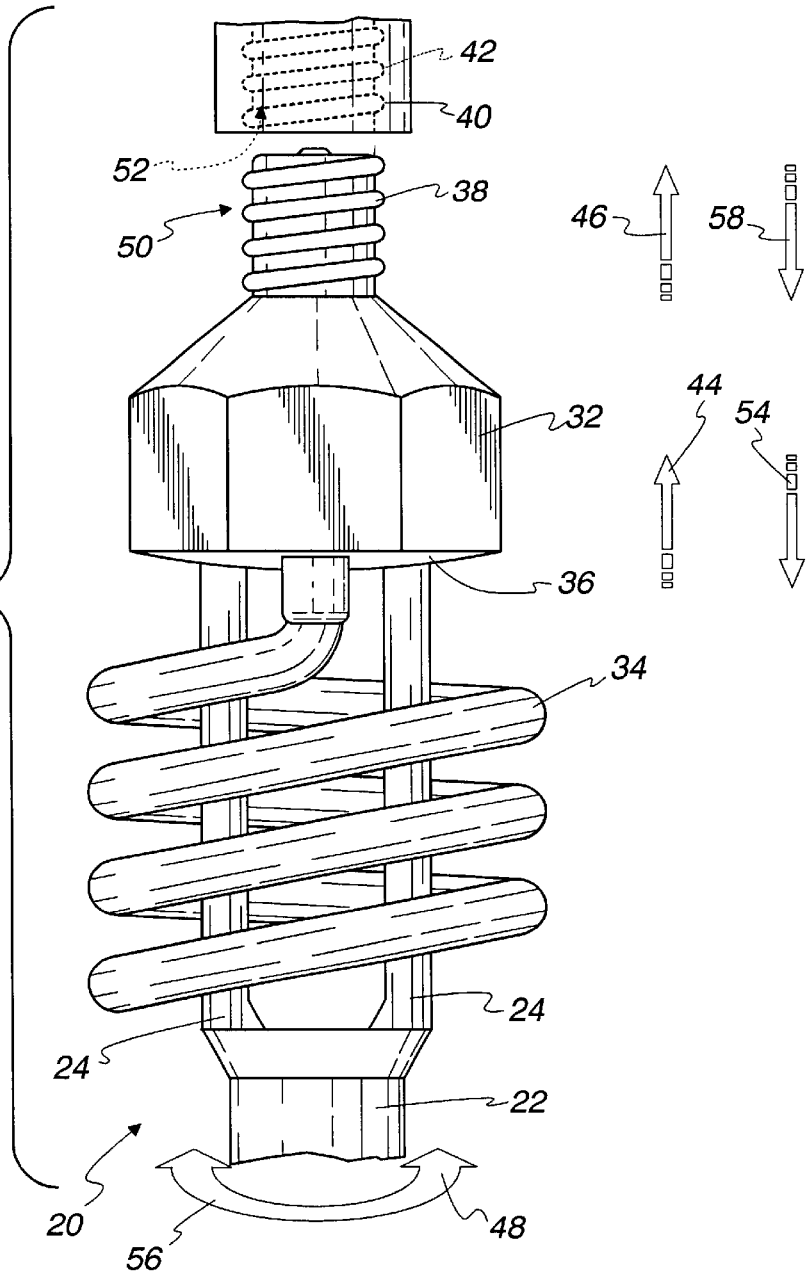
FIG. 4 is a side view the tool of FIG. 1 in an intended operational configuration with a nonglobe type light bulb.

The operational use of the tool 20 is now discussed with reference to FIG. 4. To install a non-globe light bulb 32 having a spiral tube 34, a base 36 and a male connector 38 into a fixture 40 having a female connector 42, the tool 20 is first advanced toward the spiral tube 34 upwardly as indicated by an arrow 44. The tool 20 is advanced into the spiral tube 34 until the fingers 24 abut the base 36 of the bulb 32. The fingers 24 preferably have a frictional engagement with the base 36 to allow rotational movement of the tool 20, and in particular the fingers 24, to be transferred to the bulb 32, and in particular the base 36. With the tool 20 assembled with the bulb 32, the assembly is moved upwardly in the direction indicated by an arrow 46, until the male connector 38 abuts the female connector 42. The tool 20 is then moved in a rotational direction, as indicated by an arrow 48, such that the threads 50 of the male connector 38 fully engage the threads 52 of the female connector 42. The tool 20 may then be removed as indicated by an arrow 54.

In a similar fashion, the light bulb 32 may be removed through the use of the tool 20 by first advancing the tool 20 in the direction of the arrow 44 such that the fingers 24 abut the base 36. The tool 20 is then moved in a rotational direction as indicated by an arrow 56 to fully disengage the threads 50 of the male connector 38 from the threads 52 of the female connector 42. Once the threads 50, 52 are fully disengaged, the entire assembly of the bulb 32 and the tool may be moved in the direction of the arrow 54.

As one will recognize, there are several advantages to the use of the tool 20 with the nonglobe light bulb 32. There is a decreased probability of breakage using the tool 20 with the bulb 32. Furthermore, through the use of the tool 20, it is not necessary to use a ladder to install and remove the bulb 32 by hand. As a consequence, the installation and removal of the bulb 32 is made simpler, safer, and less expensive.

The tool 20 is now discussed in greater detail with reference to FIGS. 1–3.

Turning first to the base 22, it will be recognized that the base 22 has a first end 60 and a second end 62. A wall 64 is provided at the second end 62, the wall 64 defining a receptacle 66. An interior surface 68 of the wall 64 is threaded, preferably with 4.5 threads per inch, to accept a threaded male connector.

The shaft-like fingers 24 are fixedly attached to the first end 60 of the base 22. In particular, each finger 24 has a first, free end 70 and a second end 72 which is attached to the first end 60 of the base 22. Specifically, the end 60 has a substantially circular shape in cross section, as seen in FIG. 3, and the second ends 72 of the fingers 24 are preferably attached along a diameter of the end 60 with a portion of each of the fingers 24 extending beyond an exterior cylindrical surface 74 of the base 22. The fingers 24 are attached to the base 22 such that a spacing S is provided between the fingers 24. The spacing S, as seen in FIG. 1, is preferably on the order three quarters of an inch, which preferably corresponds to a spacing on the order of one inch between the centers of the fingers 24.

The fingers 24 and the base 22 are preferably formed integrally with one another, i.e. the fingers 24 and the base 22 define a fork-like, one-piece structure 76. The structure 76 is preferably formed from a polymer material, such as polyethylene or polypropylene of medium strength. Specifically, the structure 76 may be formed using a suitable extrusion process.

At the end of each of the fingers 24 is a tip 78. The tip 78 has a gripping surface 80 which is beveled, or angled, relative to an orthogonal cross-section of the fingers 24. Specifically, an 8° angle 82 is preferably formed relative to an orthogonal plane through the finger 24. The surface 80 is made of a resilient material, such that the frictional force which may be exerted through the surface 80 against the base 36 of the bulb 32 can cause rotational movement of the fingers 24 to be transferred to cause a rotational movement of the base 34, and hence the entire bulb 32. To ensure that the surfaces 80 abut the base 36 with the tool 20 in its operational configuration, the length L of the fingers 24, as marked in FIG. 1, is on the order of three and three-eighths inches.

The pole 26, preferably a wooden or metallic pole, also has a first end 84 and a second end 86. The first end 84 has threads 88 formed thereon, preferably correspondingly mateable with the threaded surface 68 of the receptacle 66. While a pole 26 is provided for use with the fork-like structure 76, the fork-like structure 76 may be used separately from the pole 26 as an aspect of the invention.

Figure 5:
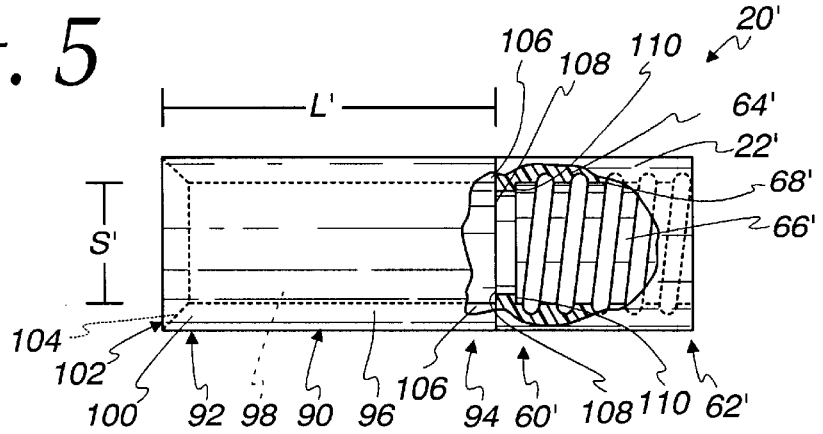
FIG. 5 is a side view of an alternative embodiment of a tool for installing and removing non-globe light bulbs according to the invention.

An alternative embodiment of the tool according to the invention is shown in FIG. 5. The embodiment of the tool according to the invention shown in FIG. 5 differs from that shown in FIGS. 1–4 only as it relates to the fingers 24. Consequently, elements in FIG. 5 which are similar to those in FIGS. 1–4 have been numbered similarly.

The tool 20' shown in FIG. 5 has a single finger 90 having a first end 92 and a second end 94. While the finger 90 is still shaft-like, unlike the fingers 24 shown in FIGS. 1–4, the finger 90 is hollow, rather than solid. Particularly, the finger 90 has a cylindrical wall 96 which defines a space 98, which is in communication with the receptacle 66' defined by the wall 64' of the base 22'. The finger 90 also has a tip 100 which defines a rim 102. The tip 100 has a surface 104 which is beveled in the same fashion that the surface 80 is beveled in FIGS. 1–4. The surface 104 performs the same function as the beveled surface 80 does in the tool 20 shown in FIGS. 1–4, i.e. the surface 104 abuts the base 36 of the bulb 32 to provide a frictional connection between the tool 20' and the base 36 such that rotational movement of the tool 20' results in rotational movement of the bulb 32.

The finger 90 also has slits 106 (of length L') to accommodate the spiral tube 34 of the bulb 32. In operation, the tube 34 would slide within the slots 106.

An interior wall 108 is also provided at the first end 60' of the base 22'. While the wall 108 is shown in FIG. 5 as an integral part of the base 22', this need not be the case. For example, a groove may be formed in the wall 64' of the base 22' and a snap ring placed within the groove to define the interior wall 108. The interior wall 108 provides a stop 110 to prevent the first end 84 of the pole 26 from being overadvanced or overinserted into the base 22'.

With respect to the assembly of the pole 26 to the combined structure 112 of the base 22' and the finger 90 as shown in FIG. 5, the method of assembly would be similar to that described above. Furthermore, the method of operation of the tool 20' relative to the bulb 32 would be similar to that described above.

Figure 6:
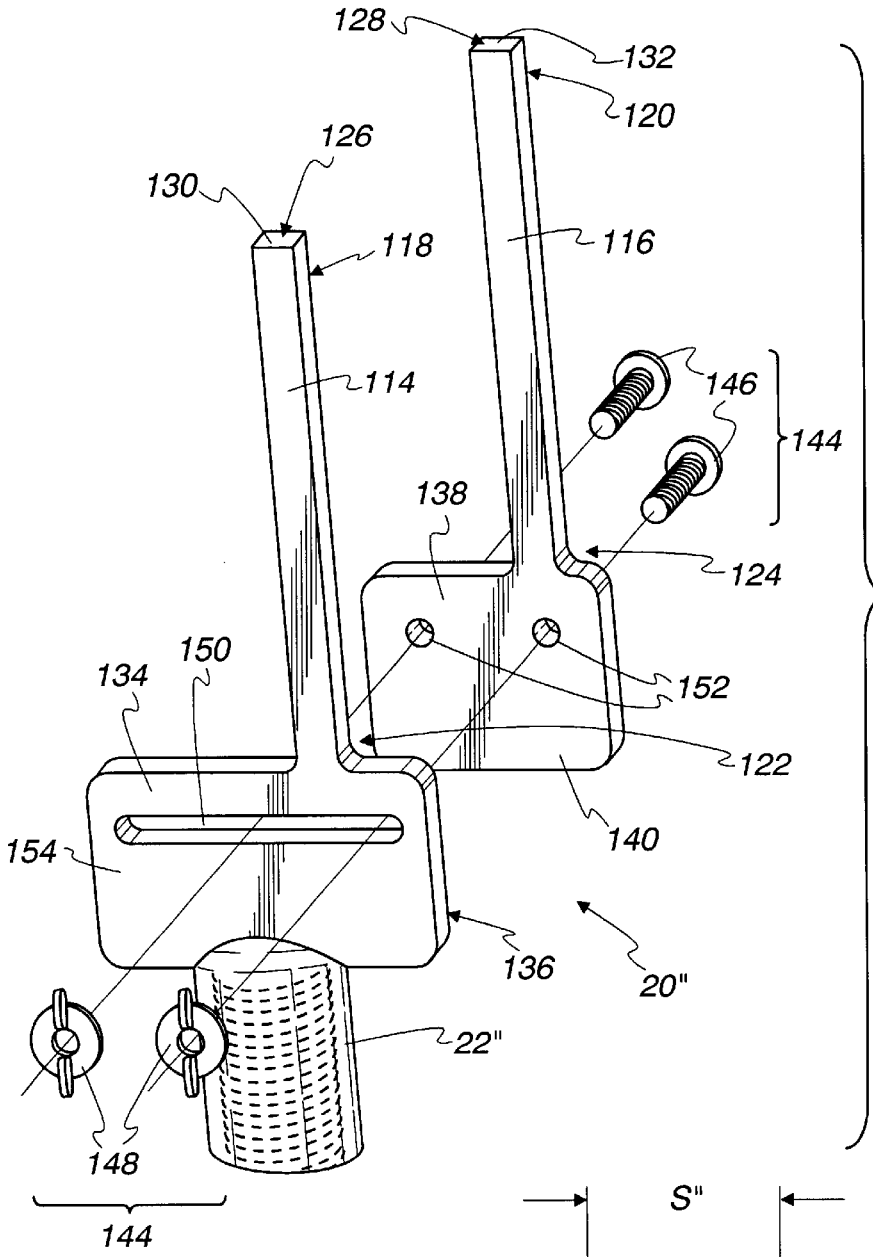
FIG. 6 is an exploded, side view of a further alternative embodiment of a tool for installing and removing non-globe light bulbs according to the invention.
Figure 7:
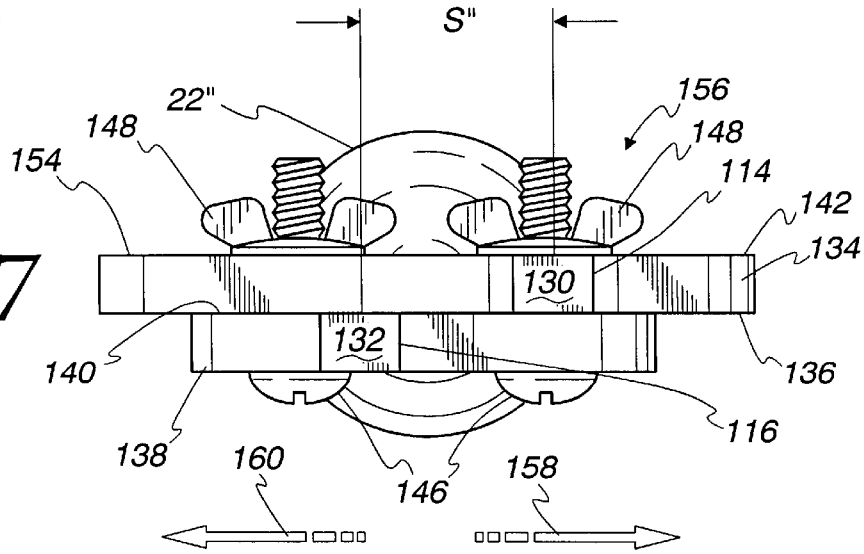
FIG. 7 is a reduced, top view of the assembled tool of FIG. 6.

A farther alternative embodiment of the tool according to the invention is shown in FIGS. 6 and 7. The embodiment of the tool according to the invention shown in FIGS. 6 and 7 differs from that shown in FIGS. 1–5 as it relates to the fingers 24, 90. Consequently, elements in FIGS. 6 and 7 which are similar to those in FIGS. 1–5 have been numbered similarly.

The tool 20" shown in FIGS. 6 and 7 has two shaft-like fingers 114, 116, each of which has a first end 118, 120 and a second end 122, 124. The first ends 118, 120 of the fingers 114, 116 each have a tip 126, 128 with a gripping surface 130, 132 which is beveled in the same fashion as the surfaces 80 in FIGS. 1–4 and the surface 104 in FIG. 5.

The second end 122 of the finger 114 is attached to base 22" of the tool 20", preferably to a first preferably rectangularly-shaped plate 134 having a preferably planar surface 136 which is formed integrally with the finger 114 and the base 22". The second end 124 of the finger 116 is attached to a second preferably rectangularly-shaped plate 138 having a preferably planar surface 140. Similar to the finger 114 and the plate 134, the finger 116 and the plate 138 are preferably integrally formed. As assembled, the plate 138 is disposed relative to the plate 134 such that the planar surface 140 abuts the planar surface 136, the plate 138 thus being slidably moveable relative to the plate 134 along an interface 142 of the surfaces 136, 140.

A securing mechanism 144 is provided to secure the plates 134, 138 to prevent movement of the plates 134, 138, and thus the fingers 114, 116, relative to each other. The securing mechanism 144 preferably includes two externally threaded bolts 146 and two internally threaded wing nuts 148. The plate 134 has a slot 150 and the plate 138 has two holes 152 through which the bolts 146 may extend. With the bolts 146 extending through the slot 150 and the holes 152, the wing nuts 148 may be secured to the bolts 146 and tightened so that the nuts 148 snugly abut against a surface 154 of the plate 134 to prevent the movement of the plates 134, 138 relative to each other.

While the foregoing preferred securing mechanism 144 has been described, it would be recognized that various alternative securing mechanisms are possible. For example, the externally threaded bolts 146 may be formed integrally with the plate 138, thereby eliminating the holes 152. Further, rather than forming a single slot 150, separate slots may be formed for each of the bolts 146. Also, only one of the bolts 146 may be threaded to accept a wing nut 148, the other bolt 146 serving only to align the plates 134, 138 when disposed in the slot 150. Still other alternatives would be readily recognizable to those of ordinary skill in the art.

With respect to the assembly of the pole 26 to the combined structure 156 of the base 22" /plate 134/finger 114 and the plate 138/finger 116, as shown in FIG. 7, the method of assembly would be similar to that described above. The method of operation, however, would be slightly different than that described above for the embodiments shown in FIGS. 1–5.

In use, the nuts 148 would first be loosened slightly such that the nuts 148 do not snugly abut the surface 154 of the plate 134, thereby allowing the plates 134, 138 (and thus the fingers 114, 116) to move freely relative to each other. The plates 134, 138 are then moved either in the direction of an arrow 158 or an arrow 160 so that a space S" is provided between the fingers 114, 116 which conforms, for example, to an internal diameter of a spiral bulb 32 into which the fingers 114, 116 are to be disposed. For example, the space S" may be determined according to the dimensions of the bulb 32 which is to be installed. The nuts 148 are then tightened so that the nuts 148 snugly abut the surface 154 of the plate 134. The combined structure 156 may then be used as described above to remove and install a bulb 32 in a fixture 40.

Use of the tool according to the invention provides several advantages.

First, it eliminates the necessity of having to use a ladder to install and remove spiral bulbs, such as the spiral bulb 32, by hand. This simplifies the procedure by eliminating the necessity of bringing and assembling a ladder beneath each light fixture which needs to have a bulb installed or removed therefrom. Also, because the ladder is no longer necessary, additional heights being accommodated by longer lengths of pole, the cost of the equipment necessary for installation and removal of the spiral bulbs 32 is decreased. Furthermore, by eliminating the necessity of having a maintenance worker scale a ladder or scaffold, it is thought that the system of installation and removal of the bulbs 32 using the tool according to the invention is safer for the maintenance worker.

Also, as the forces are transmitted between the tool according to the invention and the bulb 32 through the tips of the fingers 24, 90 and the base 36 of the bulb 32, the risks of breakage of the spiral tube 34 of the bulb are thought to be decreased. This will translate into a monetary ant savings as fewer bulbs should be broken during installation, and a safety improvement in that fewer bulbs will break during removal, possibly scattering shards of glass upon the maintenance worker or on the ground beneath the lighting fixture.

In addition, as the tool 20, 20', 20" is inserted in to the spiral tube 34 of the bulb 32, the tool 20, 20', 20" provides a self-centering function. That is, by providing fingers 24, 90, 114, 116 which cradle the spiral tube 34, the tool 20, 20', 20" centers the bulb 32, and in particular the male connector 38, for installation. This further simplifies the installation of the bulbs 32.

Other aspects, objects, and advantages of the invention will be obtained from a study of the specification, drawings, and appended claims.

I claim:

1. A tool to fasten and remove light bulbs, the tool comprising:

a base having a first end and a second end;

at least one shaft-like finger fixably attached to the base having a tip with a resilient gripping surface to transmit rotational movement of the finger to a base of a light bulb with the surface abutting the base of the light bulb; and a second shaft-like finger selectively securable to the base and having a tip with a resilient gripping surface to transmit rotational movement of the finger to a base of a light bulb with the surface abutting the light bulb; and a securing mechanism to secure the second shaft-like finger to the base with the first and second shaft-like fingers spaced apart;

wherein the base has a slot therethrough, the second finger has at least one hole therethrough, the second finger has at least one hole therethrough, and the securing mechanism comprises a bolt and a nut, the bolt disposed through the hole and the slot and the nut secured to the bolt and tightened so that the nut snugly abuts the base.

2. A tool to fasten and remove non-globe type light bulbs, the tool comprising:

a base having a first end and a second end;

a first shaft-like finger fixedly attached to the base and having a tip with a resilient gripping surface to transmit rotational movement of the first finger to a base of a light bulb with the surface abutting the base of the light bulb;

a second shaft-like finger selectively securable to the base and having a tip with a resilient gripping surface to transmit rotational movement of the second finger to a base of a light bulb with the surface abutting the base of the light bulb; and a securing mechanism to secure the second shaft-like finger to the base with the first and second shaft-like fingers spaced apart.

3. The tool according to claim 2, wherein the base has a slot therethrough, the second finger has at least one hole therethrough, and the securing mechanism comprises a bolt and a nut, the bolt disposed through the hole and the slot and the nut secured to the bolt and tightened so that nut snugly abuts the base.

4. The tool according to claim 2, wherein the base includes a plate having a slot therethrough, the second finger includes a plate having at least one hole therethrough, and the securing mechanism comprises a bolt and a nut, the bolt disposed through the hole and the slot and the nut secured to the bolt and tightened so that nut snugly abuts the base.

* * * * *